United States Patent [19]

Alskog

[11] Patent Number: 4,861,311

[45] Date of Patent: Aug. 29, 1989

[54] BEARING ARRANGEMENT FOR RODS AND AXLES IN PLASTIC TOYS

[76] Inventor: Björn Alskog, Hajdeby, S-620 23 Romakloster, Sweden

[21] Appl. No.: 151,342

[22] Filed: Feb. 2, 1988

[30] Foreign Application Priority Data

Feb. 3, 1987 [SE] Sweden ..... 8700409

[51] Int. Cl.[4] ..... A63H 17/26

[52] U.S. Cl. ..... 446/469; 446/465; 446/466

[58] Field of Search ..... 446/431, 448, 465, 466, 446/467, 468, 469, 470, 471, 88, 95, 489, 124

[56] References Cited

U.S. PATENT DOCUMENTS

| | | | |
|---|---|---|---|
| 2,510,310 | 6/1950 | Francis | 446/469 |
| 3,063,194 | 11/1962 | Berguerand | 446/466 |
| 3,082,569 | 3/1963 | Albiani | 446/471 |
| 3,083,500 | 4/1963 | Balthazor | 446/466 |
| 3,307,291 | 3/1967 | Cremer | 446/469 |
| 3,372,512 | 3/1968 | Cremer | 446/469 |
| 3,389,496 | 6/1968 | Cremer | 446/469 |

FOREIGN PATENT DOCUMENTS

| | | | |
|---|---|---|---|
| 72883 | 4/1987 | Finland . | |
| 1258912 | 3/1961 | France | 446/469 |
| 1276982 | 10/1961 | France | 446/469 |
| 1279645 | 11/1961 | France | 446/466 |
| 614569 | 12/1948 | United Kingdom | 446/469 |

*Primary Examiner*—Robert A. Hafer
*Assistant Examiner*—Sam Rimell
*Attorney, Agent, or Firm*—Flynn, Thiel, Boutell & Tanis

[57] ABSTRACT

According to the invention a solution is proposed of a current mounting problem in toy objects of plastics, primarily non-rigid plastics. The problem resides in that metal axles, rods or the like with associated details, e.g. wheels, cannot in a simple manner be mounted rigidly and permanently in its place in the toy object, on account of obstructing portions of the object. The solution proposed amounts to the axle (45) etc. being mounted in two steps, first in an opening (44'') so located that no obstacle is met, then in a second opening (44') wherein the axle (45) assumes its intended final position. The two openings (44) are united by a connecting slot (46) whose width is less than the diameter of the openings so that the axle (45) can be forced along the slot while overcoming a slight resistance of deformation. In such a way the axle (45), possible with wheels (40) mounted, can be brought to assume its final position while circumventing the obstacle.

4 Claims, 1 Drawing Sheet

BEARING ARRANGEMENT FOR RODS AND AXLES IN PLASTIC TOYS

FIELD OF THE INVENTION

The present invention relates to plastic toys, more particularly toys of non-rigid plastics, and is aimed at an arrangement for securing or carrying existing rods, axles, pins etc., preferably of metal.

BACKGROUND OF THE INVENTION

In later years increasing demands have been made upon the safety of toys, that is, they shall be so designed that the playing child is not injured, or exposed to the risk of being injured, by toys. As a matter of fact however, it is very difficult to foresee all the risks to which an unpredictable child can be exposed when playing with various toys. However, one endeavors to foresee as far as possible these risks, and ever increasing demands are made upon the design of toys. In Sweden, personnel of the National Board for Consumer Policies is examining toys from the viewpoint of safety and abroad the problem has also been noticed, particularly in the USA, where toys are subject to a comprehensive examination and checking.

Some general criteria must always be met, for example, there must not be any loose, small pieces which the child can put in its mouth, and neither must it be possible to tear such small pieces loose. If a toy is demolished during severe playing the wreck and other scraps must not be able to injure the child.

A specific problem concerns metallic objects which are components of toys, in particular toys of non-rigid plastics, thus objects in the form of axles, rods, pins etc. As a matter of course, wheel axles of a toy car must not get loose or project; such an axle is rather thin, and if freely exposed wholly or in part it can cause serious damage. Such metal objects which are components of toys must thus be rigidly secured in place and not be able to be torn loose, and neither must any part of such objects be able to lay itself bare and thereby cause damage.

These severe demands for rigid securing of metal bars and axles in toys can sometimes cause production problems which must be solved. As an example, toy cars of plastics can be mentioned, where rigid securing and fixation of the wheel axles in certain cases can cause difficult manufacturing and mounting problems, as will be exemplified in the following in connection with a statement of the background of the invention.

SUMMARY OF THE INVENTION

According to the invention there is proposed an arrangement for mounting and securing metallic axles, rods or the like in plastic toys, particularly toys of non-rigid plastics, in such cases where the mounting of the axles etc, in a conventional manner has not been possible owing to lack of accessibility. Thus according to the invention the axle at each end is mounted on the toy by means of a pair of openings connected by a slot.

BRIEF DESCRIPTION OF THE DRAWINGS

The invention will now be described, although only by way of example with reference to the accompanying drawings, wherein.

Figure 5:
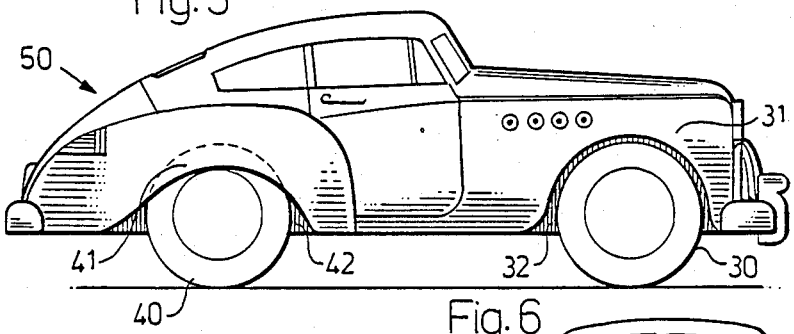
FIG. 5 shows an elevation of a toy car of plastics.
Figure 7A:
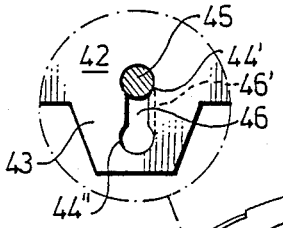
FIG. 7 shows the rear part of the toy car of FIG. 5 with certain portions removed for making the invention clear.
Figure 7:
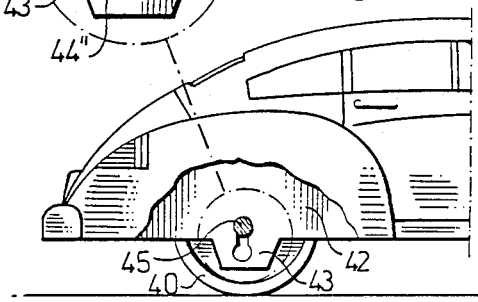
Figure 8:
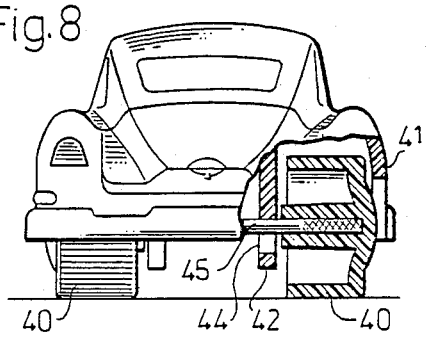

FIG. *7a* shows an enlarged detail of FIG. 7. Finally,

FIG. 8 is a view of the toy car according to FIG. 5 seen straightly from behind with certain portions shown in section.

DETAILED DESCRIPTION

Figure 1:
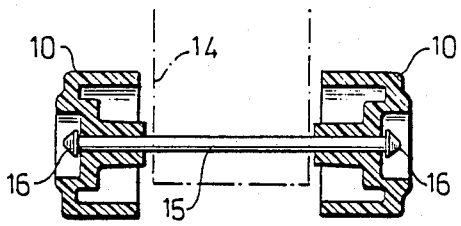
FIG. 1 shows diagrammatically a conventional manner of mounting wheels with the associated axle in a toy car, whereas FIG. 2 demonstrates a hazard related to such a wheel suspension.
Figure 2:
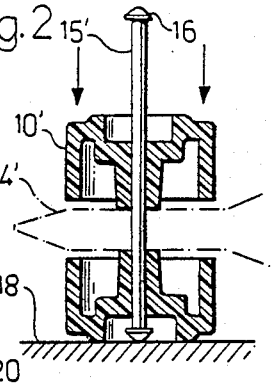

Thus there is shown in FIG. 1 a complete wheel suspension for a toy car, the suspension being of a conventional design, now abandoned. Two wheels 10 are carried on an axle 15, one on either end thereof. Dash-dot lines 14 indicate an intermediate part, e.g. of the body of a toy vehicle of non-rigid plastics, in which part the axle 15 is carried. The wheels are retained on the axle 15 by the axle being provided with end upsetting 16, and mounting can be carried out either by the wheels and a smooth axle being placed in the body, after which the ends are upset by means of a tool, or by the axle first being made with its upset ends after which it is pushed by force through undersize bearing openings in the wheels and the body, dimensions being such that it is then impossible for a child to teach the wheels loose. The hazard is another, as illustrated in FIG. 2. Suppose that the vehicle is over-turned and pressed against the floor 18, perhaps by the child itself who has fallen. As indicated by the arrows in FIG. 2 the top wheel 10' in particular is subjected to a heavy pressure from above. The intermediate part 14' of the chassis is compressed and a dangerous, projecting portion 15' is exposed.

Figure 3:
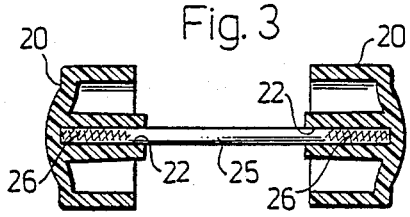
FIG. 3 corresponds to FIG. 1 but shows the wheels mounted on their axle in such a way that the calamity according to FIG. 2 be avoided.
Figure 4:
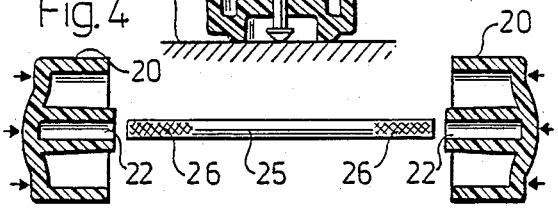
FIG. 4 illustrates the preliminary stage of the wheel mounting procedure resulting in the assembly of FIG. 3.

In order that this particular accident be avoided the wheel assembly could be designed e.g. as shown in FIG. 3. Here the hub openings 22 of the wheels 20 are blind and do not pass through the wheel. The axle 25 bottoms in the openings into which it is pressed, the axle ends being provided in their surface with suitable gripping means, e.g. a cross knurling 26, so as to offer the plastics of the wheel hubs a firm grip. Thus the wheels 20 can neither be torn loose from or be pushed in over the axle. In this case mounting must be carried out in a suitable fixture, in doing which the axle 25 is placed properly in the toy object, whereas the wheels 20 are positioned for being pushed sideways onto the axle ends by means of a suitable tool, as indicated by the arrows in FIG. 4.

However, this method of mounting may pose problems in that several toy objects are so formed that the wheels simply cannot be pushed on straight laterally. FIG. 5 shows an example of this.

Figure 6:
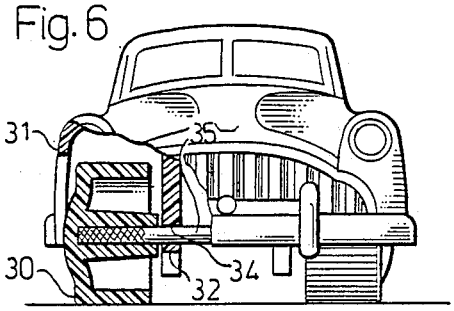
FIG. 6 is a front view of this car with certain portions shown in section.

In FIG. 5 there is thus shown a true copy of an automobile 50 of an earlier date ("Buick 1949"). The car is made of non-rigid plastics (PVC) in of a shell internally reinforced by suitable partition walls and lugs located such that the wheels can be carried therein. As seen from FIG. 5, mounting the front wheels 30 is no problem; these wheels clear the surrounding fender 31 and can be pushed on straight from the side, as also illustrated in FIG. 6 which shows the car according to FIG. 5 seen from the front. In an inner reinforcing wall 32 the front axle 35 is received in bearing openings 34 and as can be seen the front wheels 30 can be pushed on straight from the side, as the lower edge of each front fender 31 is at a higher level than the top side of the corresponding wheel 30.

However, as to the rear wheels 40 it is a different matter; see FIG. 5. A characteristic feature of this car model was the rear fenders extending down over the rear wheels. Hence, in the toy edition the rear wheels 40 cannot be pushed on straight from the side according to the above, as the depending rear fenders are in the way. However, this mounting problem is solved in a simple way by the invention; see FIG. 7. Also in this part of the toy car there are partition walls 42, which, in fact, may coincide with the walls 32 above mentioned. At the location for the rear axle bearing each partition wall 42 has a depending portion or lug 43 wherein two bearing openings 44 are formed, one upper 44′ and one lower 44″. The two openings are connected by a slot 46 whose width is less than the diameter of the openings 44. When placed in a fixture the rear axle is located in the lower 44″ of the bearing openings and here mounting can take place as just described without the rear fender being an obstacle, as in this position the wheel will clear the fender. After mounting, when the wheels are rigidly secured on their rear axle 45, the axle is forced up into its upper position, in the bearing opening 44′, which operation can be carried out by a reasonable manual effort, in so far as the width of the connecting slot 46 is adjusted in relationship to the stiffness of the non-rigid plastics. According to circumstances the length of this connecting slot 46 can vary, from practically nil when the two bearing openings are close together as in FIG. 8, to an extended, symmetrical or unsymmetrical (46′), dumb-bell shape. In this way the mounting problem is thus solved while meeting the decisive condition that nothing of the wheel assembly, neither wheels nor axle, should be possible to tear loose from the rest of the vehicle.

It should be added that the arrangement according to the invention, besides solving a mounting problem, brings with it that the toy car, or other toy objects having similar mounting problems, obtains a further "play value" by the possibility of repositioning the wheel axles. There is nothing to prevent that the same arrangement be applied for carrying the front wheels, in spite of the fact that they, in this particular case, do not pose any mounting problem. From this follows of course that the bearing openings, if desired for the sake of play, can be more than two and lined up with the connection slots forming an angle with each other.

Once again it is pointed out that the toy car shown and described only exemplifies the invention; the bearing arrangement proposed can be applied for solving several mounting problems relating to the suspension of metal rods, axles, pins etc. in elastic toys and, as indicated above, neither is the invention limited to the specific embodiment shown but can take other forms within the scope of the invention.

I claim:

1. A toy, comprising:

a body of plastics material having an axle supporting wall;

an axle;

means defining a closed perimeter bearing opening through said wall for receiving said axle therethrough, said closed perimeter bearing opening being formed by at least two substantially circular holes, located on spaced centers and connected by a slot whose width is less than the diameter of the circular holes, said holes being of a diameter to slidably and rotatably receive said axle therethrough, said axle being insertable in said bearing opening only axially in view of the closed perimeter of said opening, means on said body interfering with axial insertion of said axle in the second of said holes but not in the first of said holes, said first hole being so located on said wall that the axle can be inserted axially therethrough without obstacle, said second hole representing the working position of the axle, said slot being of width less than the diameter of said axle, the width of said slot being set in relation to the stiffness of the plastic material of said wall so that the axle can be pushed radially from said first hole through said slot to said second hole by overcoming a resistance to deformation of said wall at said slot, said axle being positively retained against radial movement out of said bearing opening by the closed perimeter of said bearing opening.

2. Apparatus according to claim 1, wherein said holes and intermediate slot are of dumb-bell shape.

3. Apparatus according to claim 1, wherein the length of the slot between the holes is short relative to said hole diameter so that the bearing opening is of figure 8 shape.

4. Apparatus according to claim 1 including wheels mountable on said axle, said toy being a toy car of non-rigid plastics, said car having depending fenders preventing mounting of the wheels when the axle is in its said working position, said depending fenders defining said interfering means, a pair of said bearing openings, a pair of said walls, said walls being internal portion walls of said car, said bearing openings being provided on both sides of the toy car in respective depending portions of said internal partition walls in the car, said given bearing openings having the second hole being positioned above the first hole and the length of the connecting slot selected so that the wheels can be mounted on the axle with the axle in the first, lower holes without being obstructed by the depending fenders, the axle and wheels thereon being shiftable up to their working position by pressing the axle up through the connecting slots into the upper holes.

* * * * *